US008779938B2

(12) United States Patent
Shi et al.

(10) Patent No.: US 8,779,938 B2
(45) Date of Patent: Jul. 15, 2014

(54) ROAD TRAFFIC CONTROL SYSTEM

(75) Inventors: Zheng Shi, Shenzhen (CN); Jiang-Feng Liu, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 65 days.

(21) Appl. No.: 13/446,798

(22) Filed: Apr. 13, 2012

(65) Prior Publication Data

US 2013/0049993 A1 Feb. 28, 2013

(30) Foreign Application Priority Data

Aug. 31, 2011 (CN) ..... 2011 1 0254624

(51) Int. Cl.
*G08G 1/00* (2006.01)

(52) U.S. Cl.
USPC ..... 340/928; 340/933; 340/936; 701/301; 701/117; 701/118; 701/119

(58) Field of Classification Search
USPC ..... 340/928, 933, 936; 701/301, 117, 118, 701/119
See application file for complete search history.

(56) References Cited

U.S. PATENT DOCUMENTS

| | | | | |
|---|---|---|---|---|
| 5,490,661 | A * | 2/1996 | Stevens et al. | 256/13.1 |
| 6,223,125 | B1 * | 4/2001 | Hall | 701/301 |
| 6,246,948 | B1 * | 6/2001 | Thakker | 701/93 |
| 6,539,175 | B1 * | 3/2003 | Geary et al. | 396/59 |
| 7,190,306 | B2 * | 3/2007 | Janssen | 342/118 |
| 8,224,522 | B2 * | 7/2012 | Ikeda et al. | 701/36 |
| 2005/0156757 | A1 * | 7/2005 | Garner | 340/907 |
| 2006/0269104 | A1 * | 11/2006 | Ciolli | 382/104 |
| 2007/0274158 | A1 * | 11/2007 | Agam et al. | 367/96 |
| 2008/0119965 | A1 * | 5/2008 | McCrary | 701/2 |
| 2009/0102699 | A1 * | 4/2009 | Behrens et al. | 342/109 |
| 2009/0256911 | A1 * | 10/2009 | Hakki et al. | 348/149 |
| 2010/0128127 | A1 * | 5/2010 | Ciolli | 348/143 |

* cited by examiner

*Primary Examiner* — Daryl Pope
(74) *Attorney, Agent, or Firm* — Novak Druce Connolly Bove + Quigg LLP

(57) ABSTRACT

A road traffic control system is applied to an intersection to control traffic and includes a light support, three traffic lights, a speed measuring device, a light controller, and an alarm. The light support is installed at one lane at the intersection; the three traffic lights are installed on the light support to control traffic. The speed measuring device is installed on guardrails on the lane to measure current speed of vehicle. When one of the traffic lights changes its color to indicate stopping, the light controller synchronously controls the speed measuring device to detect the current speed of the vehicle that is passing through the speed measuring device, and compares the measured speed of the vehicle with a preset speed limit. The alarm outputs warning signals when the measured speed is above the preset speed limit.

20 Claims, 3 Drawing Sheets

ROAD TRAFFIC CONTROL SYSTEM

CROSS-REFERENCE TO RELATED APPLICATION

This application is related to a co-pending U.S. patent application Ser. No. 13/446,792, entitled "ROAD TRAFFIC CONTROL SYSTEM", by Zhen Shi et al. Said application has the same assignee as the present application and is concurrently filed herewith. The disclosure of the above-identified application is incorporated herein by reference.

BACKGROUND

1. Technical Field

The disclosure generally relates to a road traffic control system.

2. Description of the Related Art

With the rapid development of urbanization, traffic problems have become increasingly serious. For example, when a car drives behind a truck approaching an intersection, the driver in the car may not see the traffic lights at the intersection because the truck is blocking the traffic lights from line of sight, which may cause a traffic accident if the driver of the car is not careful.

Therefore, there is room for improvement within the art.

BRIEF DESCRIPTION OF THE DRAWINGS

Many aspects of a road traffic control system can be better understood with reference to the following drawings. The components in the drawings are not necessarily drawn to scale, the emphasis instead being placed upon clearly illustrating the principles of the road traffic control system. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
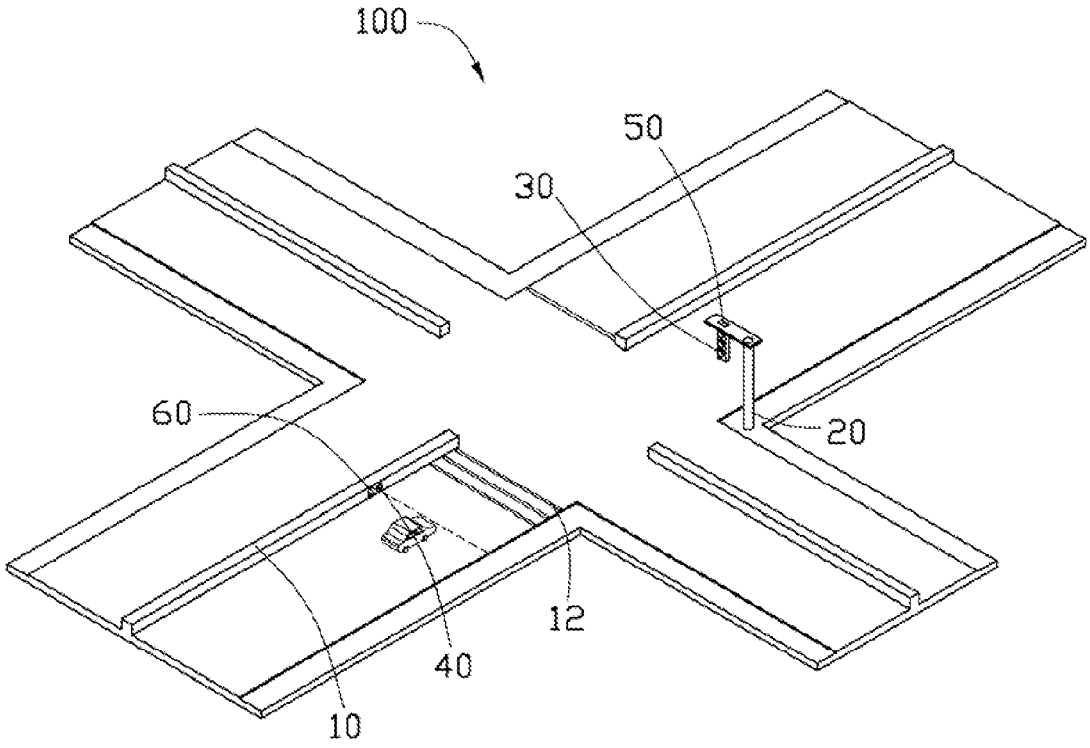
FIG. 1 is a schematic view of one embodiment of a road traffic control system applied to a road of the disclosure.

FIG. 1 is a schematic view of one embodiment of a road traffic control system 100 applied to a road of the disclosure. In this embodiment, the road traffic control system 100 is used at an intersection to control and manage traffic; a number of guardrails 10 are positioned on the road in a row to divide the road into different lanes. Each lane defines a plurality of stop lines on the surface of the lane.

Figure 2:
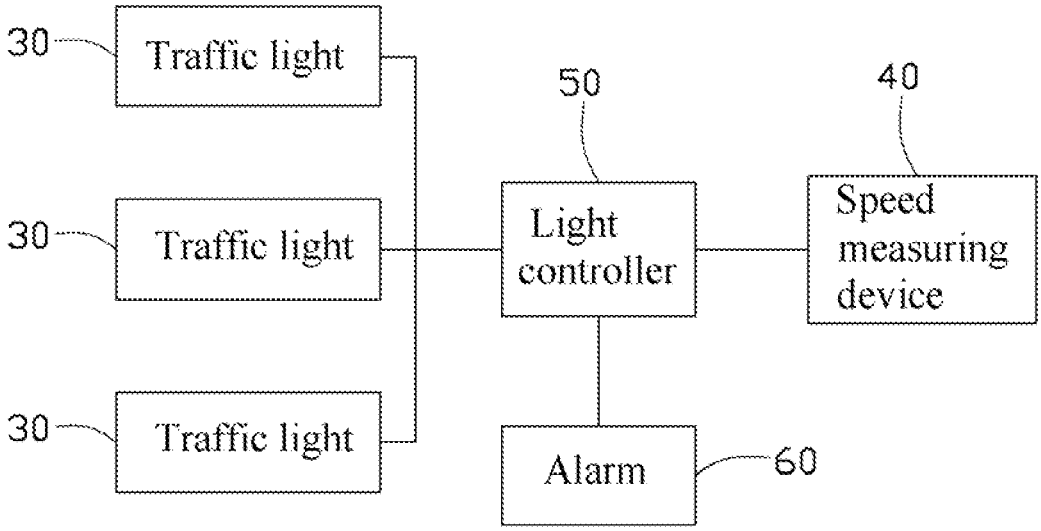
FIG. 2 is a block view of one embodiment of the road traffic control system shown in FIG. 1 of the disclosure.

Also referring to FIG. 2, the road traffic control system 100 includes a light support 20, three traffic lights 30, a speed measuring device 40, a light controller 50, and an alarm 60. The light support 20 is installed at the edge of one lane at the intersection. The traffic lights 30 are installed on the light support 20 and are positioned above the lane at road intersection to control traffic. The traffic lights 30 alternate the priority (right of way) of road users by displaying lights of a standard color (e.g., yellow, red, and green) under the control of the light controller 50 to warn the pedestrians and drivers.

The speed measuring device 40 can be a radar speed gun which can measure the speed of moving vehicles. In this embodiment, the speed measuring device 40 is about 10 meters away from a first stop line 12 which is close to the road intersection on the lane. The speed measuring device 40 is installed on the guardrails 10.

The light controller 50 can be installed on the light support 20 or the guardrails 10. In this embodiment, the light controller 50 is positioned on the light support 20 and is electrically connected to the traffic lights 30 and the speed measuring device 40. The light controller 50 synchronously controls the traffic lights 30 and turns on or off the speed measuring device 40. For example, when the light controller 50 controls the traffic lights 30 to emit red light or yellow light, the speed measuring device 40 is activated at the same time. When the light controller 50 controls the traffic lights 30 to emit green light, the light controller 50 then deactivates the speed measuring device 40 to save power.

A speed limit, such as a maximum allowable speed, is preset based on the distance between the speed measuring device 40 and the first stop line 12, is stored in the light controller 50. In this embodiment, since the distance between the first stop line 12 and the speed measuring device 40 is about 10 meters, the speed limit of 10 kilometers per hour (km/h) is allowable when the car drives past the speed measuring device 40. That is, if the speed of the car is equal to or below 10 km/h, and the car starts braking at the time of passing the speed measuring device 40, the car will gradually halt in front of the first stop line 12 after a movement of 10 meters or less.

The alarm 60 is positioned on the guardrails 10 and is adjacent to the speed measuring device 40, and is electrically connected to the light controller 50. When the traffic lights 30 are changed to yellow or red color, the light controller 50 receives the current speed of the car from the speed measuring device 40 in time, and compares the current speed with the speed limit to turn on or off the alarm 60 according to the comparison. For example, when the light controller 50 determines that the current speed (e.g., 15 km/h) from the speed measuring device 40 is larger than the speed limit (e.g., 10 km/h), the light controller 50 sends a command signal to the alarm 60 to activate and enable the alarm 60 to output warning signals, informing the driver that the traffic lights 30 have changed to yellow or red color, so that the driver can brake the car as soon as possible.

When a car drives to the intersection and the driver of the car cannot see the traffic lights 30 because of the line of sight being blocked by other vehicles. If the traffic lights 30 have changed to yellow or red color, the speed measuring device 40 sends radar signal to the car that is passing through the measuring device 40, and receives returned radar signal from the car to measure the current speed of the car. The light controller 50 compares the measured speed with the speed limit and sends a command signal to the alarm 60 when the measured speed is larger than the speed limit. Thus, the alarm 60 outputs the warning signals to remind the driver that the traffic lights 30 have changed to yellow or red color and to promptly slow down or stop.

Figure 3:
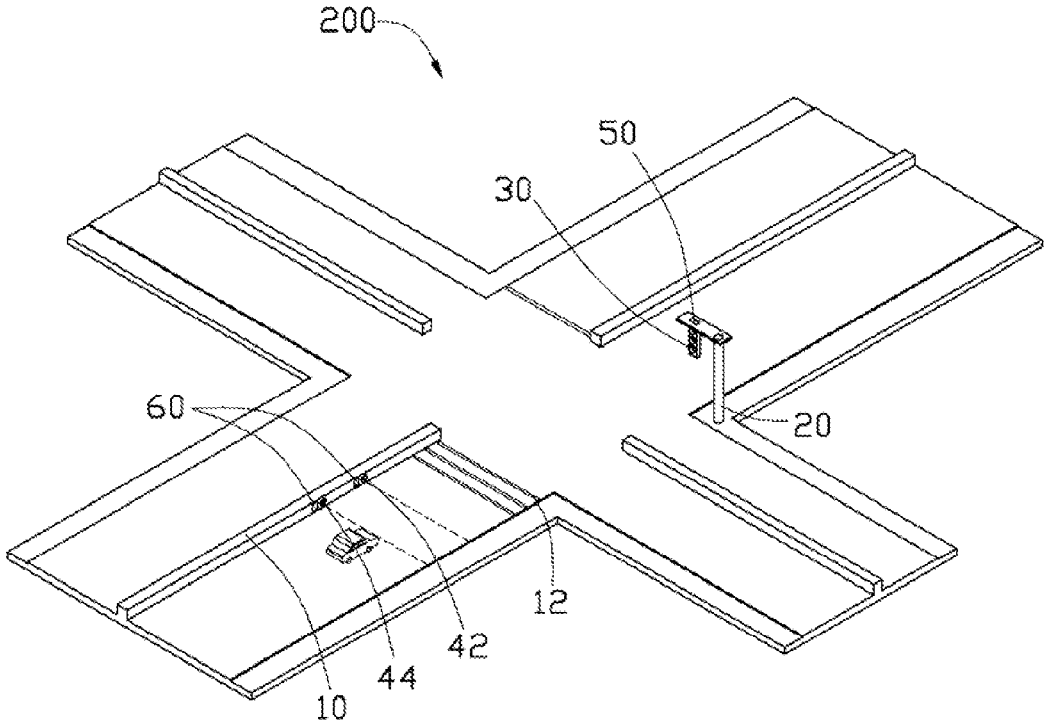
FIG. 3 is a schematic view of another embodiment of a road traffic control system applied to a road of the disclosure.

FIG. 3 is a schematic view of another embodiment of a road traffic control system 200 applied to a road of the disclosure. In this embodiment, the road traffic control system 200 is substantially similar to the road traffic control system 100 of the first embodiment, and includes a first speed measuring device 42, a second speed measuring device 44 and the two alarms 60. The two speed measuring devices 42 and 44 are electrically connected to the light controller 50 and are installed on the guardrails 10 in a row. The first speed measuring device 42 is about 10 meters away from the first stop line 12; the second speed measuring device 44 is about 20 meters away from the first stop line 12. The two alarms 60 are respectively positioned adjacent to the first speed measuring device 42 and the second measuring device 44.

Each speed measuring device corresponds to a speed limit, for example, the speed limit corresponding to the first speed measuring device 42 is about 10 km/h, and the speed limit corresponding to the second speed measuring device 44 is about 20 km/h. Thus, the two speed measuring devices can measure and record the moving speed of the cars in time to control and manage the road traffic according to the road controls in time, avoiding traffic violations or accidents.

In summary, in the road traffic control system 100 of the disclosure, the speed measuring device 40 is installed on the guardrails 10 of the lane, the light controller 50 can synchronously control the traffic lights 30 and the speed measuring device 40 to startup or shutdown. Thus, when the traffic lights 30 are changed to red or yellow color, the speed measuring device 40 is activated to measure the current speed of the cars that are driving through the speed measuring device 40. Therefore, even through the traffic lights 30 are blocked from line of sight, the alarm 60 can output warning signals to remind the driver that the traffic lights 30 have changed to yellow color or red color in the intersection, avoiding violations or accidents.

In the present specification and claims, the word "a" or "an" preceding an element does not exclude the presence of a plurality of such elements. Further, the word "comprising" does not exclude the presence of elements or steps other than those listed.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in the matters of shape, size, and arrangement of parts within the principles of this exemplary disclosure to the full extent indicated by the broad general meaning of the terms in which the appended claims are expressed.

What is claimed is:

1. A road traffic control system comprising:

a traffic light positioned above one lane at an intersection;

a speed measuring device installed on guardrails on the lane; and a light controller electrically connected to the traffic light and the speed measuring device, wherein the light controller synchronously controls the traffic light and the speed measuring device, when the traffic light changes its color to indicate stopping, the light controller controls the speed measuring device to measure current speed of vehicle that is driving through the speed measuring device.

2. The road traffic control system as claimed in claim 1, further comprising a light support installed at the edge of the lane at the intersection, wherein the traffic light is installed on the light support and are positioned above the lane at the road intersection to control traffic, and each lane comprise a plurality of stop lines on the surface of the lane.

3. The road traffic control system as claimed in claim 1, wherein the traffic light alternates the priority of road users by displaying lights of a yellow color, a red color, or a green color under the control of the light controller to warn the pedestrians and drivers.

4. The road traffic control system as claimed in claim 1, wherein the speed measuring device is a radar speed gun and sends a radar signal to the vehicle and receives a returned radar signal from the moving vehicle to measure the current speed of the vehicle at which it is pointed by detecting a change in frequency of the returned radar signal.

5. The road traffic control system as claimed in claim 1, wherein the light controller is positioned on the light support, when the light controller controls the traffic light to emit red light or yellow light, the speed measuring device is activated at the same time; when the light controller controls the traffic light to emit green light, the light controller deactivates the speed measuring device to save power.

6. The road traffic control system as claimed in claim 2, wherein the light controller stores a speed limit that is preset based on the distance between the speed measuring device and a first stop line, when the distance between the first stop line and the speed measuring device is 10 meters, the speed limit of 10 kilometers per hour (km/h) is allowable when the vehicle drives past the speed measuring device.

7. The road traffic control system as claimed in claim 6, wherein if the speed of the vehicle is equal to or below 10 km/h, and the vehicle starts braking at the time of passing the speed measuring device, the vehicle will gradually halt in front of the first stop line after a movement of 10 meters or less.

8. The road traffic control system as claimed in claim 1, further comprising an alarm, wherein the alarm is positioned on the guardrails and is adjacent to the speed measuring device, and is electrically connected to the light controller, the light controller receives the current speed of the vehicle from the speed measuring device in time, and compares the current speed with a preset speed limit to turn on or off the alarm according to the comparison.

9. The road traffic control system as claimed in claim 8, wherein when the light controller determines that the current speed from the speed measuring device is larger than the speed limit, the light controller sends a command signal to the alarm to activate and enable the alarm to output warning signals and inform drivers that the traffic light has changed to yellow or red color.

10. The road traffic control system as claimed in claim 1, further comprising two alarms, wherein the speed measuring device comprises a first speed measuring device and a second speed measuring device, the two alarms are positioned adjacent to the first speed measuring device and the second measuring device respectively, the first speed measuring device and the second speed measuring device are electrically connected to the light controller and are installed on the guardrails in a row, and the first speed measuring device is substantially 10 meters away from the first stop line; the second speed measuring device is substantially 20 meters away from the first stop line.

11. A road traffic control system applied to an intersection to control traffic, the road traffic control system comprising:

a light support installed at one side of one lane at the intersection;

three traffic lights installed on the light support and positioned above one lane at the intersection to control traffic;

a speed measuring device installed on guardrails on the lane to measure current speed of vehicle;

a light controller electrically connected to the traffic lights and the speed measuring device; and an alarm electrically connected to the light controller, wherein when the traffic lights are changed to yellow or red color, the light controller synchronously controls the speed measuring device to detect the current speed of the vehicle that is passing through the speed measuring device, and compares the measured speed of the vehicle with a preset speed limit, and the alarm outputs warning signals when the measured speed is above the speed limit.

12. The road traffic control system as claimed in claim 11, wherein the traffic lights alternate the priority of road users by displaying lights of a standard color under the control of the light controller to warn the pedestrians and drivers.

13. The road traffic control system as claimed in claim 11, wherein the speed measuring device is a radar speed gun and sends a radar signal to the vehicle and receives a returned radar signal from the moving vehicle to measure the current speed of the vehicle at which it is pointed by detecting a change in frequency of the returned radar signal.

14. The road traffic control system as claimed in claim 11, wherein the light controller is positioned on the light support, when the light controller controls the traffic lights to emit red light or yellow light, the speed measuring device is activated at the same time; when the light controller controls the traffic lights to emit green light, the light controller deactivates the speed measuring device to save power.

15. The road traffic control system as claimed in claim 11, wherein the speed limit is preset based on the distance between the speed measuring device and a first stop line on the lane, when the distance between the first stop line and the speed measuring device is 10 meters, the speed limit of 10 kilometers per hour (km/h) is allowable when the vehicle drives past the speed measuring device.

16. The road traffic control system as claimed in claim 15, wherein if the speed of the vehicle is equal to or below 10 km/h, and the vehicle starts braking at the time of passing the speed measuring device, the vehicle will gradually halt in front of the first stop line after a movement of 10 meters or less.

17. The road traffic control system as claimed in claim 11, wherein the alarm is positioned on the guardrails and is adjacent to the speed measuring device, the light controller receives the current speed of the vehicle from the speed measuring device, and compares the current speed with the preset speed limit to turn on or off the alarm according to the comparison.

18. The road traffic control system as claimed in claim 17, wherein when the light controller determines that the current speed from the speed measuring device is larger than the preset speed limit, the light controller sends a command signal to the alarm to activate and enable the alarm to output warning signals and inform drivers that the traffic lights have changed to yellow or red color.

19. The road traffic control system as claimed in claim 11, further comprising a first speed measuring device, a second speed measuring device and the two alarms positioned adjacent to the first speed measuring device and the second measuring device respectively, the first speed measuring device and the second speed measuring device are electrically connected to the light controller and are installed on the guardrails in a row.

20. The road traffic control system as claimed in claim 19, wherein the first speed measuring device is substantially 10 meters away from the first stop line; the second speed measuring device is substantially 20 meters away from the first stop line, and the speed limit corresponding to the first speed measuring device is about 10 kilometers per hour (km/h), the speed limit corresponding to the second speed measuring device is about 20 km/h.

* * * * *